US008657424B2

(12) United States Patent
Rittgers et al.

(10) Patent No.: US 8,657,424 B2
(45) Date of Patent: Feb. 25, 2014

(54) INK SUPPLY CONTAINER

(75) Inventors: William Jon Rittgers, Celbridge (IE); Michael Mulloy, Dublin (IE); Odhran Hendley, Celbridge (IE); Mark Loughlin, Gorey (IE); Eduardo Macias, Clonee (IE)

(73) Assignee: Hewlett-Packard Development Company, L.P., Houston, TX (US)

( * ) Notice: Subject to any disclaimer, the term of this patent is extended or adjusted under 35 U.S.C. 154(b) by 187 days.

(21) Appl. No.: 13/255,275

(22) PCT Filed: Mar. 9, 2009

(86) PCT No.: PCT/US2009/036555

§ 371 (c)(1),
(2), (4) Date: Sep. 8, 2011

(87) PCT Pub. No.: WO2010/104500

PCT Pub. Date: Sep. 16, 2010

(65) Prior Publication Data

US 2012/0001990 A1 Jan. 5, 2012

(51) Int. Cl.
*B41J 2/175* (2006.01)

(52) U.S. Cl.
USPC ..... 347/86; 347/19; 347/40; 347/49; 347/85; 347/87

(58) Field of Classification Search
None
See application file for complete search history.

(56) References Cited

U.S. PATENT DOCUMENTS

| | | | | |
|---|---|---|---|---|
| 5,408,746 | A * | 4/1995 | Thoman et al. | 29/890.1 |
| 5,995,721 | A | 11/1999 | Rourke et al. | |
| 6,012,808 | A * | 1/2000 | Koitabashi et al. | 347/86 |
| 6,019,459 | A | 2/2000 | Pew et al. | |
| 6,033,064 | A | 3/2000 | Pawlowski, Jr. et al. | |
| 6,095,643 | A | 8/2000 | Cook et al. | |
| 6,152,558 | A * | 11/2000 | Togashi et al. | 347/86 |
| 6,474,790 | B2 | 11/2002 | Kaneko | |
| 6,796,635 | B2 * | 9/2004 | Shinada | 347/49 |
| 6,969,154 | B2 | 11/2005 | Takeuchi et al. | |
| 7,399,073 | B2 | 7/2008 | Rittgers et al. | |
| 2003/0011667 | A1 | 1/2003 | Jones et al. | |
| 2003/0076391 | A1 | 4/2003 | Wilson et al. | |
| 2004/0080591 | A1 | 4/2004 | Cho et al. | |
| 2004/0119787 | A1 | 6/2004 | Mori | |
| 2005/0057623 | A1 | 3/2005 | Shindo | |
| 2005/0146581 | A1 | 7/2005 | Miyazawa et al. | |
| 2007/0070147 | A1 | 3/2007 | Hattori et al. | |
| 2007/0103520 | A1 | 5/2007 | Wu | |
| 2008/0036813 | A1 | 2/2008 | Conway et al. | |
| 2008/0122897 | A1 | 5/2008 | Toyoda et al. | |

* cited by examiner

*Primary Examiner* — Jason S Uhlenhake

(57) ABSTRACT

An ink supply container includes a first portion and a second portion. The first portion is configured to hold a first volume of ink and is configured to be releasably connectable to a printhead. The second portion is configured to hold a second volume of ink and is in communication with the first portion. The second portion is configured to extend over a top of at least one other ink supply container upon releasable connection of the first portion of the container to a printhead assembly.

11 Claims, 6 Drawing Sheets

INK SUPPLY CONTAINER

BACKGROUND

Printing in color or in black provides great flexibility. However, in some instances, such as a business setting, printing occurs mostly in black. Accordingly, businesses typically have a printer or multifunction machine that is dedicated to black ink. In other examples, a color printer typically will have several colors from which to print process colors and at least one black ink. This black ink is used to print black or also can be used with other process colors. Despite the availability of printing in color, printing in black occurs much more frequently than printing in color. Accordingly, black ink is typically consumed quicker than the color inks.

However, once the printer and its ink supply mechanism is provided to the consumer, the capacity of the black ink supply relative to the capacity of the color ink supply is generally fixed. Accordingly, while a consumer may enjoy the flexibility of printing in color or black, the consumer may be limited in their efficiency of printing in black because of the number of cartridges or ink supply containers that have to be used to achieve high volume printing in black.

BRIEF DESCRIPTION OF THE DRAWINGS

The accompanying drawings are included to provide a further understanding of embodiments and are incorporated in and constitute a part of this specification. The drawings illustrate embodiments and together with the description serve to explain principles of embodiments. The embodiments will be readily appreciated as they become better understood by reference to the following detailed description. The elements of the drawings are not necessarily to scale relative to each other. Like reference numerals designate corresponding similar parts.

DETAILED DESCRIPTION

In the following Detailed Description, reference is made to the accompanying drawings, which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments can be positioned in a number of different orientations, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

Embodiments of the present disclosure provide an array of ink supply containers in which an ink supply container, such as a first ink supply container, is configured with a volume that is substantially larger than the volume of the other ink supply containers. In one embodiment, the first container includes a first portion and a second portion, both of which are configured to hold ink. The second portion extends generally perpendicular to the first portion and is in fluid communication with the first portion. When all of the ink supply containers are arranged together as an ink supply assembly, the second portion of the first container extends over a top portion of at least some of the other ink supply containers.

With this arrangement, the first container holds a substantially larger volume of ink than the other containers in the array of ink supply containers. In some embodiments, a height of the other ink supply containers is substantially less than the height of the first portion of the first container. In other words, the other ink supply containers are configured with a reduced size or volume to accommodate the second portion of the container within the space that would otherwise would have been occupied by the other containers had they retained their normal size or volume.

In some embodiments, the first container holds a black ink to provide a super-capacity black ink supply container without eliminating the color ink supply containers from the ink supply assembly. With this arrangement, by simply substituting using a set of shorter color ink supply containers and an over-sized, L-shaped black ink supply container, an ink supply assembly is modified to enable achieving high volume printing in black for a color printer.

These embodiments and additional embodiments are described in association with FIGS. 1-12.

Figure 1:
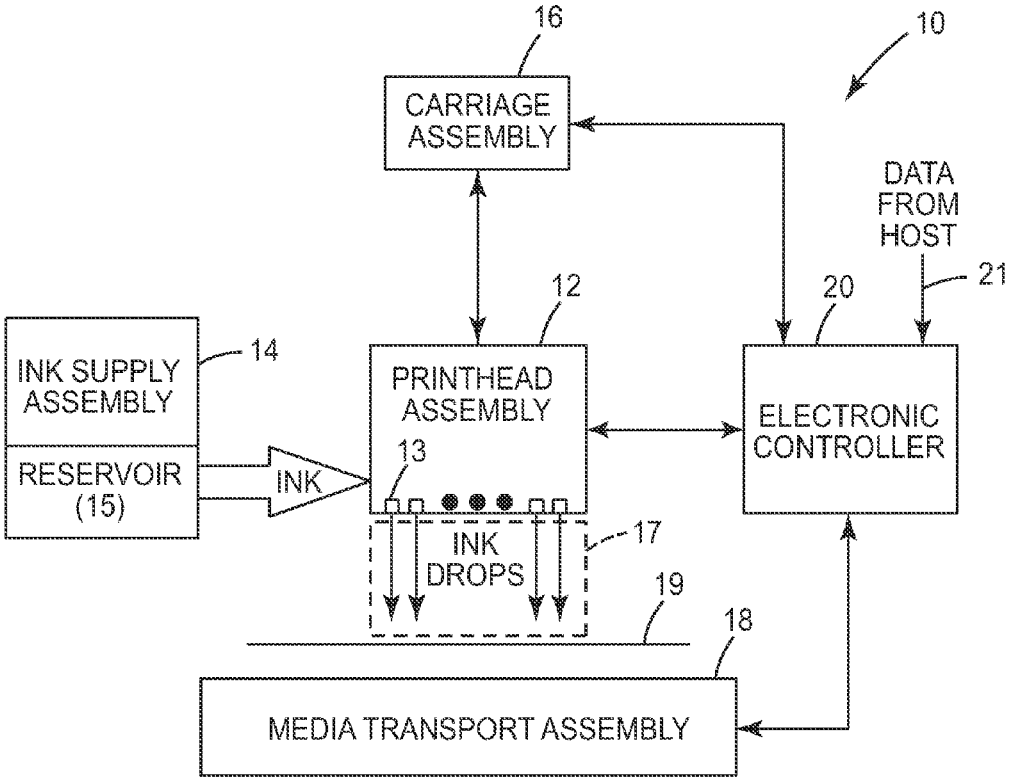
FIG. 1 is schematic illustration of a printing system, according to an embodiment of the present disclosure.

FIG. 1 illustrates an inkjet printing system 10 in accordance with one embodiment of the present disclosure. Inkjet printing system 10 includes an inkjet printhead assembly 12, an ink supply assembly 14, a carriage assembly 16, a media transport assembly 18, and an electronic controller 20. Inkjet printhead assembly 12 includes one or more printheads which eject drops of ink through orifices or nozzles 13 and toward a print media 19 so as to print onto print media 19. Print media 19 is any type of suitable sheet material, such as paper, card stock, envelopes, labels, transparencies, Mylar, and the like. Typically, nozzles 13 are arranged in one or more columns or arrays such that properly sequenced ejection of ink from nozzles 13 causes characters, symbols, and/or other graphics or images to be printed upon print media 19 as inkjet printhead assembly 12 and print media 19 are moved relative to each other.

Ink supply assembly 14 supplies ink to printhead assembly 12 and includes a reservoir 15 for storing ink. As such, ink flows from reservoir 15 to inkjet printhead assembly 12. In one embodiment, inkjet printhead assembly 12 and ink supply assembly 14 are housed together in an inkjet cartridge or pen. In some embodiments, ink supply assembly 14 is separate from inkjet printhead assembly 12 but still directly communicates ink to the printhead assembly 12 via a releasable connection with the ink supply assembly 14 being mounted directly above and at least partially supported by the printhead assembly 12. This embodiment is sometimes referred to as an on-axis configuration of the ink supply assembly 14 and will later described in association with at least FIGS. 2, 11, and 12.

However, in other embodiments, the ink supply assembly 14 is positioned remotely from the printhead assembly 12, with the ink supply assembly 14 communicating ink to the printhead assembly 12 via an array of supply tubes. This embodiment is sometimes referred to as an off-axis configuration of the ink supply assembly 14 and will be later described in association with at least FIG. 10.

Carriage assembly 16 positions inkjet printhead assembly 12 relative to media transport assembly 18 and media transport assembly 18 positions print media 19 relative to inkjet printhead assembly 12. Thus, a print zone 17 is defined adjacent to nozzles 13 in an area between inkjet printhead assembly 12 and print media 19. In one embodiment, inkjet printhead assembly 12 is a non-scanning type printhead assembly. As such, carriage assembly 16 fixes inkjet printhead assembly 12 at a prescribed position relative to media transport assembly 18. Thus, media transport assembly 18 advances or positions print media 19 relative to inkjet printhead assembly 12.

Electronic controller 20 communicates with inkjet printhead assembly 12, media transport assembly 18, and, in one embodiment, carriage assembly 16. Electronic controller 20 receives data 21 from a host system, such as a computer, and includes memory for temporarily storing data 21. Typically, data 21 is sent to inkjet printing system 10 along an electronic, infrared, optical or other information transfer path. Data 21 represents, for example, an image, a document, and/or file to be printed. As such, data 21 forms a print job for inkjet printing system 10 and includes one or more print job commands and/or command parameters.

In one embodiment, electronic controller 20 provides control of inkjet printhead assembly 12 including timing control for ejection of ink drops from nozzles 13. As such, electronic controller 20 operates on data 21 to define a pattern of ejected ink drops which form characters, symbols, and/or other graphics or images on print media 19. Timing control and, therefore, the pattern of ejected ink drops, is determined by the print job commands and/or command parameters. In one embodiment, logic and drive circuitry forming a portion of electronic controller 20 is located on inkjet printhead assembly 12. In another embodiment, logic and drive circuitry is located remotely from inkjet printhead assembly 12.

Figure 2:
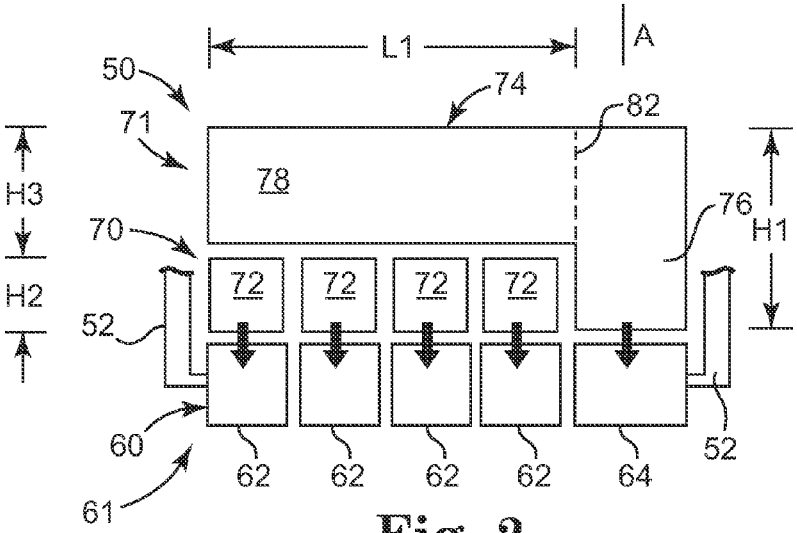
FIG. 2 is front plan view schematically illustrating a printhead assembly and ink supply assembly, according to one embodiment of the present disclosure.

FIG. 2 is a side plan view schematically illustrating a print assembly 50, according to one embodiment of the present disclosure. As shown in FIG. 2, print assembly 50 comprises a printhead assembly 61, an ink supply assembly 71, and a carriage 52. Carriage 52 supports the printhead assembly 61 and the ink supply assembly 71, wherein the printhead assembly 61 includes an array 60 of printheads 62, 64 and the ink supply assembly 71 includes an array 70 of ink supply containers 72, 74. In one embodiment, printheads 62 are formed on a single die. As shown in FIG. 2, each of the respective containers 72, 74 is releasably connectable to a top portion of a respective one of the printheads 62, 64 as shown in FIG. 2. In one aspect, each container 72 is sized and shaped to extend substantially directly above its respective printhead 62. However, in another aspect, container 74 includes a first portion 76 extending directly above its printhead 64 such that the first portion 76 has a vertical orientation within carriage 52. A second portion 78 of container 74 extends generally horizontally or perpendicular relative to a longitudinal axis (represented by line A) of the first portion 76. As shown in FIG. 2, a boundary line denoting the distinction between the second portion 78 and the first portion 76 is represented by dashed line 82. The second portion 78 is in fluid communication with the first portion 76 to permit the passage of air and ink between the first portion 76 and the second portion 78.

In one embodiment, the first portion 76 of container 74 has a height (H1) that is substantially greater than a height (H2) of the containers 72. While many conventional ink supply containers have a generally uniform height, in this embodiment, the height of the containers 72 is substantially less than their normally configured height in order to accommodate the generally horizontally extending second portion 78. In one aspect, second portion 78 has a height (H3) with a sum of the height (H2) of container 72 and the height (H3) of second portion 78 of container 74 being approximately equal to the height (H1) of first portion 76 of container 74. In this arrangement, ink supply assembly 71 provides an enlarged (and differently shaped) first container 74 and a reduced size of containers 72, while generally maintaining the overall size or volume of the ink supply assembly (prior to the modifications of the size and/or shape of containers 72, 74).

With this arrangement, container 74 comprises an extra large capacity ink supply container to provide a high volume of frequently used ink while providing a reduced volume of color inks. In one embodiment, container 74 contains black ink while containers 72 contain other colors of ink. In some other embodiments, container 74 contains a non-black color ink.

Figure 3:
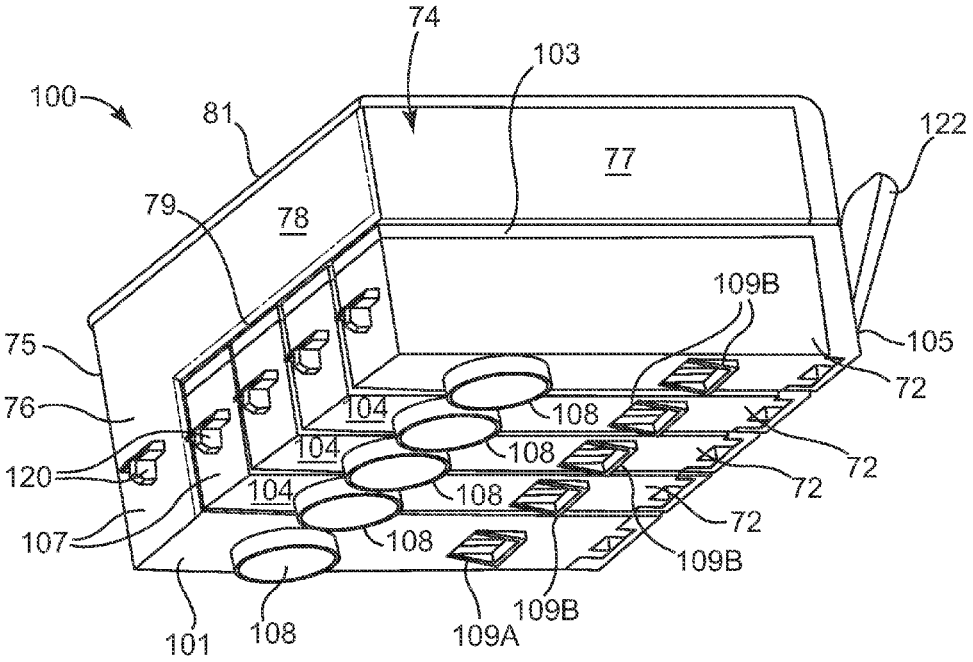
FIG. 3 is perspective view of an ink supply assembly, according to one embodiment of the present disclosure.

FIG. 3 is a perspective view of an ink supply assembly 100, according to one embodiment of the present disclosure. As shown in FIG. 3, ink supply assembly 100 includes at least substantially the same features and attributes of the ink supply assembly 71, as previously described in association with FIG. 2.

In one aspect, container 74 includes a first side 75, a second side 77, a top surface 81, and a front surface 107. In addition, first portion 76 of container 74 includes a bottom surface 101 while second portion 78 includes a bottom surface 79. In one aspect, first portion 76 of container 74 includes an ink port 108 and an ink level window 109A formed on bottom surface 101.

In general terms, the containers 72 are arranged in a side-by-side and generally parallel relationship with the containers 72 sized to nest underneath the second portion 78 of container 74. With this arrangement, a sum of the height (H2) of the containers 72 and the height (H3) of the second portion 78 is substantially equal to the height (H1) of the first portion 76 of container 74 (as shown in FIG. 2).

In one aspect, each container 72 includes an ink port 108 and an ink level window 109B formed on bottom surface 104. In addition, a rear portion 105 of each container 72 and a rear portion (not shown in FIG. 3) of container 74 includes a releasable connection tab 122.

In some embodiments, each container 72 and 74 includes a generally T-shaped protrusion 120 on their front surface 107 with the protrusion 120 configured to releasably connect to a reciprocating portion of a carriage of a printer (as will be described in association with FIG. 4). It is understood that protrusions 120 are not strictly limited to a T-shape and that other shapes suitable for releasably anchoring the containers can be used. In cooperation with the tab 122, the protrusion 120 insures that each container 72, 74 is positioned properly relative to the printheads 62, 64 (respectively) and secured within carriage 52.

As shown in FIG. 3, when nested together containers 72 and container 74 form a generally rectangular shape. In some embodiments, it will be understood that one or more containers 72 can include one of the protrusions 120 as a key on a top portion 103 (FIG. 3, 6) of the container 72 with the key configured to reciprocally mate with a key hole on a bottom surface 79 of the second portion 78 of the first container 74 to releasably secure the container(s) 72 relative to the first container 74 in the nested relationship. Moreover, it is further understood that in the embodiments in which the key formed on top surface 103 of the container 72, the key comprises any one of a variety of shapes including, but not limited to, the generally T-shaped configuration of protrusion 120. Likewise, the key hole in the bottom surface 79 of the second portion 78 of the first container 74 comprises a shape reciprocating the key on the container 72, such as the generally T-shaped recess 157 described later in association with FIG. 4. With this key-key hole arrangement, one or more of the protrusions 120 on front portion 107 of containers 72, 74 can be omitted. In one example in which the key-key hole arrangement is present, the protrusion 120 on the front portion 107 of the container 74 is omitted while the protrusions 120 on the front portion 107 of the containers 72 are retained. In this example, the container 74 becomes properly positioned in carriage 52 by virtue of the proper positioning of the containers 72 via protrusions 120.

Figure 4:
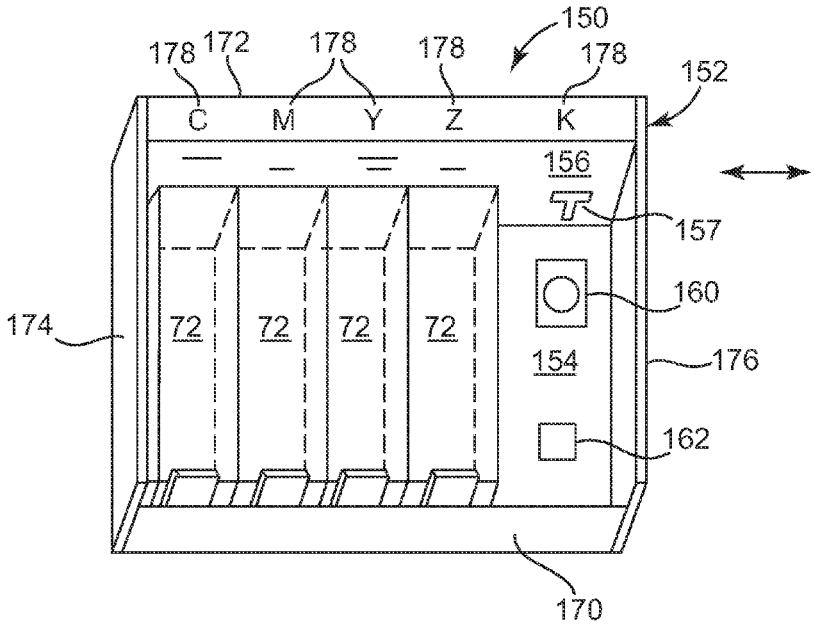
FIG. 4 is a top perspective view of a printing assembly, according to one embodiment of the present disclosure.

FIG. 4 is a top perspective view of a printhead assembly 150 including a carriage 152 and the array of ink supply containers 72, according to one embodiment of the present disclosure. As shown in FIG. 4, carriage 152 includes a first end portion 170, a second end portion 172, a first side 174, and a second side 176. In one aspect, second end portion 172 includes an interior wall 156 defining a series of generally T-shaped recesses 157 configured to releasably receive the T-shaped protrusion 120 of containers 72 and 74 to thereby anchor containers 72, 74 relative to interior wall 156. In addition, carriage 152 is configured to support the printheads 62, 64 so that the ink port 160 and interface 162 of each printhead 62, 64 is accessible (via floor 154 of carriage 152) to connect to the ink port 108 and ink level windows 109A, 109B of the containers 72, 74, as shown in FIG. 4.

In another aspect, FIG. 4 illustrates the containers 72 in a releasably installed position within the carriage 152 and thereby in operable communication and connection with their respective printheads 62 (not shown). In some embodiments, second end portion 172 also includes color indicators 178 that indicate the particular color of ink supply container 72 that is to be installed at the indicated position on carriage 152.

Figure 5:
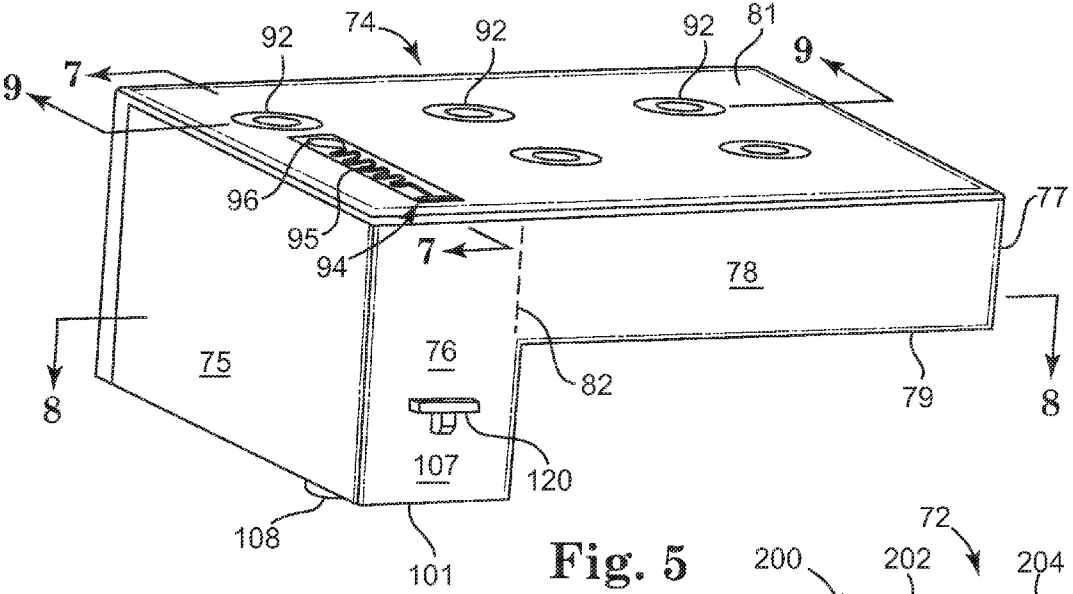
FIG. 5 is front perspective view of a large capacity ink supply container, according to one embodiment of the present disclosure.

FIG. 5 is a front perspective view illustrating an ink supply container, according to one embodiment of the present disclosure. In one embodiment, container 74 shown in FIG. 5 includes at least substantially the same features and attributes as the container 74 that was previously described in association with FIGS. 2-4. As shown in FIG. 5, among other previously identified features, container 74 includes a top surface 81 comprising an array of fill ports 92 and a labyrinth vent mechanism 94, which includes recessed vent pathway 95 and vent port 96. The labyrinth vent mechanism 94 implements a known technique for providing venting while slowing the rate of evaporation. Accordingly, although not shown for illustrative clarity, labyrinth vent mechanism 94 further includes a top portion provided by a tape or label secured to extend over the recessed vent pathway 95 and vent port 96.

Figure 6:
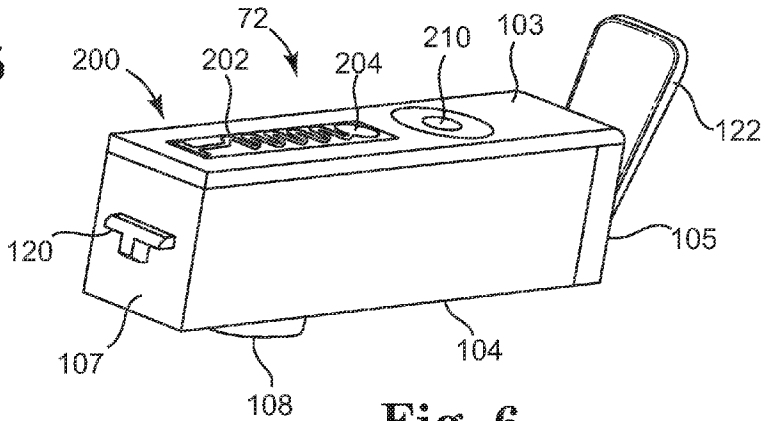
FIG. 6 is a front perspective view of a reduced capacity ink supply container, according to an embodiment of the present disclosure.

FIG. 6 is a perspective view illustrating an ink supply container, according to one embodiment of the present disclosure. In one embodiment, container 72 shown in FIG. 6 includes at least substantially the same features and attributes as the container 72 that was previously described in association with FIGS. 2-4. As shown in FIG. 6, among other previously identified features, container 72 also includes a fill port 210 and a labyrinth vent mechanism 200, which includes recessed vent pathway 202 and vent port 204. In one aspect, the labyrinth vent mechanism 200 incorporates a tape or label (not shown) similar to that previously identified for labyrinth vent mechanism 94.

Figure 7:
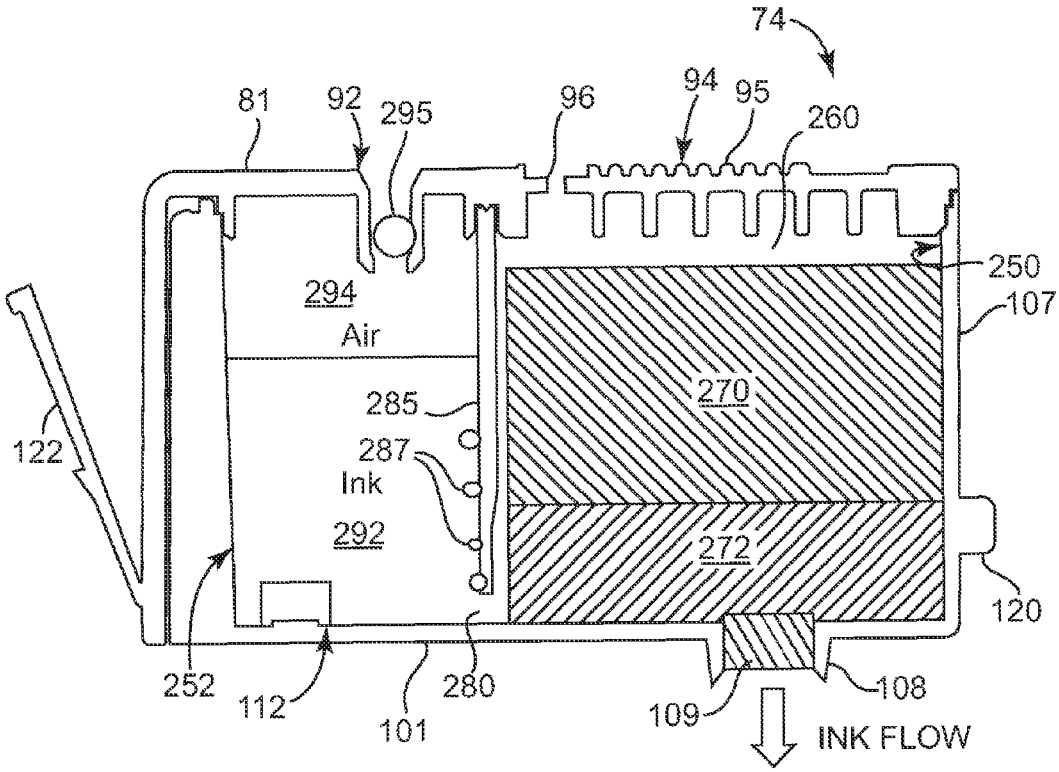
FIG. 7 is a sectional view as taken along lines 7-7 of FIG. 5, according to one embodiment of the present disclosure.
Figure 8:
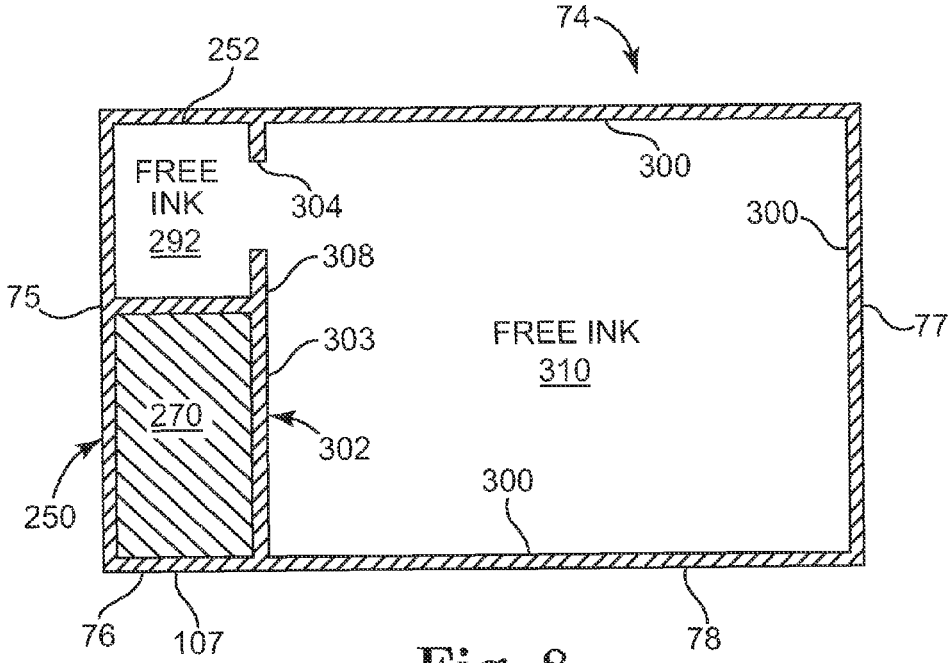
FIG. 8 is a sectional view as taken along lines 8-8 of FIG. 5, according to one embodiment of the present disclosure.
Figure 9:
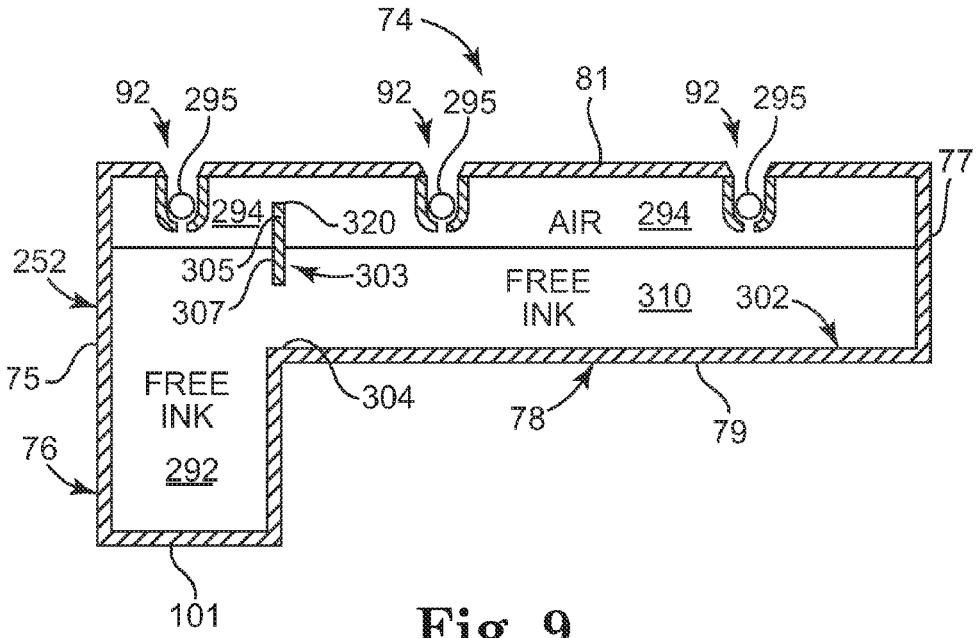
FIG. 9 is a sectional view as taken along lines 9-9 of FIG. 5, according to one embodiment of the present disclosure.

FIGS. 7-9 are sectional views of container 74 that schematically illustrate various internal features and other components of container 74. FIG. 7 is a sectional view as taken along lines 7-7 of FIG. 5 and schematically illustrates the components and operation of the first portion 76 of container 74, according to one embodiment of the present disclosure. As shown in FIG. 7, in general terms, container 74 includes a first compartment 250 and a second compartment 252. First compartment 250 holds a volume of ink via a first capillarity media 270 and a second capillarity media 272. The second capillarity media 272 is positioned directly over ink port 108, which provides a communication path of the ink to the connected printhead (not shown). In one aspect, ink port 108 includes a wick element 109.

Second compartment 252 holds a free volume of ink 292 and air 294. The second compartment 252 is in fluid communication with the first compartment via gap 280 of a wall 285 that divides the first compartment 250 from the second compartment 252. As schematically illustrated in FIG. 7, in cooperation with labyrinth vent mechanism 94, gap 280 acts as part of a bubbler mechanism to provide a backpressure regulation mechanism that allows air (represented by bubbles 287) to replace liquid drawn from the free ink compartment 252. In one embodiment, fill port 92 includes cork 295 that acts to hermetically seal port 92, and thereby seal compartment 252.

In one aspect, labyrinth vent mechanism 94 is positioned over a top of the first compartment 250 to provide venting to the first compartment 250 and to the second compartment 252. With an already established pressure gradient between the first compartment 250 and the second compartment 252, pressure is gradually released in a controlled fashion via the bubbler gap 280, thereby allowing liquid to be drawn into the respective high and low capillarity medias 272, 270 to replenish the ink in first compartment 250.

A general operation of the ink supply container 74 will be described later after the introduction of the sectional views of FIGS. 8-9.

FIG. 8 is a sectional view as taken along lines 8-8 of FIG. 5 of container 74. As shown in FIG. 8, first compartment 250 holds first capillarity media 270 while second compartment 252 holds free ink 292. Second portion 78 defines a chamber 302 that holds free ink 310 and is in fluid communication with second compartment 252 via port 304, thereby allowing a free flow of ink 310 into second compartment 252 as needed. In one aspect, chamber 302 is defined by outer wall 300 and an inner wall 303 that separates first compartment 250 from chamber 302 of second portion 78. In another aspect, inner wall 303 also separates the chamber 302 from the second compartment 252, except that in this region 308, the inner wall 303 defines the port 304 that enables fluid communication between the chamber 302 and the second compartment 252.

FIG. 9 is a sectional view as taken along lines 9-9 of FIG. 5 of container 74. As shown in FIG. 9, both second compartment 252 and a top portion 81 of second portion 78 define an array of fill ports 92. In addition, FIG. 9 illustrates that inner wall 303 extends vertically between second compartment 252 and the chamber 302 of second portion 78. A bottom portion 307 of the inner wall 303 in this region defines port 304 to permit passage of free ink 310 therethrough into second compartment 252 while an upper portion 305 of inner wall 303 in this region defines a vent port 320 that maintains a generally equal air pressure between the second compartment 252 and the chamber 302 of second portion 78.

With the structures shown in FIGS. 5 and 7-9 in mind, in one embodiment the general operation of the ink supply container 74 begins with releasable connection of the first portion 76 of the container 74 via mounting the ink port 108 onto a reciprocating portion of a printhead. As fluid communication is established and printing uses ink in container 74, ink is first drawn from the low capillarity media 270. After a requisite number of uses, the ink within low capillarity media 270 becomes depleted, thereby exposing air to an airpathway to the bubbler gap 280, such that air bubbles into the free ink 292 of second compartment 252 as ink is drawn into the first compartment 250. It will be understood to those skilled in the art that the bubbler gap 280 controls a predetermined bubble pressure according to the size of gap 280 and molded features on wall 285.

With further reference to FIG. 7, with the relief of back pressure via bubbles 287 that are released into the second compartment 252, free ink 292 in the second compartment 252 is drawn into the high capillarity media 272 for passage through ink port 108 into the printhead. Free ink 292 is also drawn into low capillarity media 270, thereby blocking the air pathway to bubbler gap 280 which, in turn, deactivates the bubbler mechanism to prevent uncontrolled flow of ink 292. Moreover, because second portion 78 of container 74 provides a chamber 302 (FIGS. 8-9) with free ink 310, this free ink 310 flows into the second compartment 252 as ink is drawn into the high capillarity media 272. Initially, ink 310 in chamber 302 (FIGS. 8-9) of second portion 78 of container 74 and ink 292 in second compartment 252 will act as a single body of ink until the level of ink 292 falls below the bottom surface 79 of second portion 78. At this time, substantially all of the ink 310 in chamber 302 in second portion 78 will be gone. It will be understood that ink will be drawn from the second compartment 252 into the low and high capillarity media 270, 272 of the first compartment 250 at a rate that is slower than the rate at which ink flows from chamber 302 of second portion 78 into second compartment 252 of first portion 76.

With regard to first portion 76, via the interaction of the first compartment 250 and second compartment 252, free ink 292 will be cyclically drawn into low capillarity media 270 and high capillarity media 272 as the bubbler gap 280 is cyclically exposed as ink is consumed through port 108.

Accordingly, as a general summary, the extra volume of ink supplied via second portion 78 of container 74 is used in combination with the free ink 292 in second compartment 252 to extend the useful life and capacity of the ink supply container 74. Without the chamber 302 of free ink 310 in the second portion 78, the free ink 292 in ink supply container 74 would be limited to the volume of the second compartment 252. Accordingly, second portion 78 provides a substantially greater quantity of free ink while not substantially altering the operation of the internal components of the first portion 76 (including the respective capillarity media and back pressure mechanisms).

In some embodiments, the first portion 76 of the container 74 omits the low capillarity media and the second compartment 252 of free ink to provide a simpler ink supply container. However, it will be understood that the bubbler mechanism (including gap 280) is retained in a modified form or an alternate backpressure regulator is implemented. In these modified embodiments, the free ink 310 from second portion 78 would flow directly into first compartment 250 and high capillarity media 272 with the understanding that appropriate venting and backpressure mechanisms are implemented. It will be further understood that in some embodiments other arrangements of capillarity media, venting, backpressure mechanisms, and/or free ink compartments are used to provide first portion 76 of an ink supply container in which the second portion 78 would readily supply free ink to the first portion 76 at an appropriate stage of emptying of ink from the first portion 76 of container 74.

With the addition of the second portion 78 of container 74, container 74 provides a substantially larger volume of ink than conventional ink supply containers. In one non-limiting example, container 74 provides 3 to 4 times more volume of free ink than a conventional container having a size corresponding to the size of first portion 76 (i.e. without the second portion 78).

Figure 10:
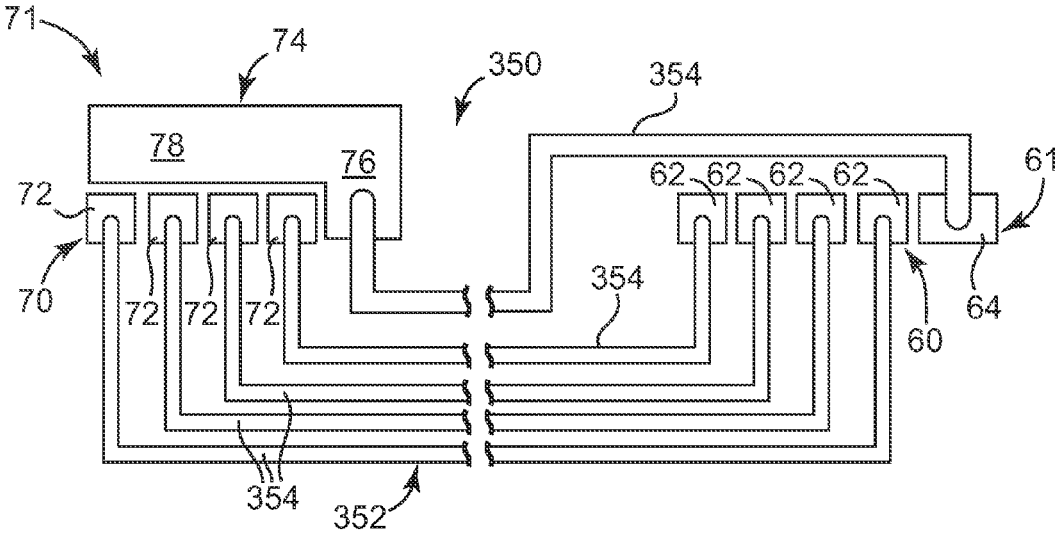
FIG. 10 is a schematic illustration of an ink supply assembly and a printhead assembly, according to one embodiment of the present disclosure.

FIG. 10 is a plan view schematically illustrating a system 350 including a printhead assembly 61 and an ink supply assembly 71, according to one embodiment of the present disclosure. In one embodiment, the ink supply assembly 71 includes substantially the same features of the ink supply assembly 71 previously described in association with FIGS. 2-9.

As shown in FIG. 10, the ink supply assembly 71 is located remotely from the printhead assembly 61 with an array 352 of conduits 354 establishing fluid communication between the containers 72, 74 and the printheads 62, 64. This general arrangement is commonly referred to as a printhead assembly 61 having an off-axis ink supply. However, unlike conventional off-axis ink supply systems, in this embodiment, ink supply assembly 71 includes an over-sized container 74 that includes a second portion 78 that extends over the top of the other containers 72 to provide a much larger capacity of one color of ink for the assembly 71.

It will be understood that in some embodiments the off-axis ink supply system 350 schematically illustrated in FIG. 10 utilizes pumps and/or backpressure mechanisms (which are familiar to those skilled in the art) that are separate from the remotely located ink supply containers 72, 74.

Figure 11:
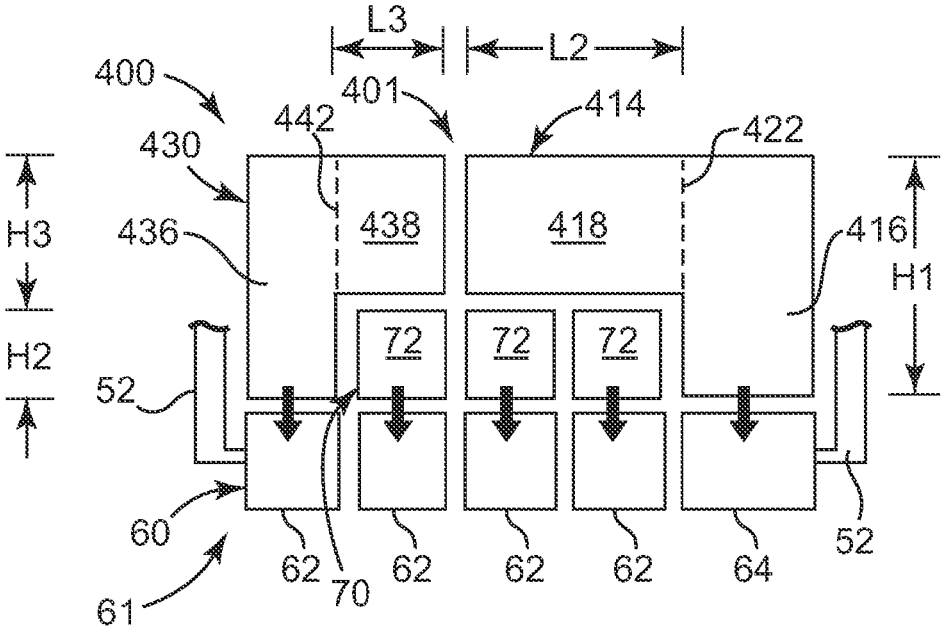
FIG. 11 is front plan view schematically illustrating a printhead assembly and an ink supply assembly, according to one embodiment of the present disclosure.

In some embodiments, more than one ink supply container is configured with a second portion that extends over a top portion of other containers of the array. For example, FIG. 11 illustrates a system 400 including a printhead assembly 61 and an on-axis ink supply assembly 401, according to one embodiment of the present disclosure. In one embodiment, the system 400 comprises substantially the same features and attributes of the system 50 (as previously described in association with FIG. 2) except that two of the ink supply containers are configured as over-sized containers. In particular, ink supply assembly 401 includes an array 70 of containers 72, a first over-sized container 414, and a second over-sized container 430. As shown in FIG. 11, containers 414 and 430 are simultaneously present or mounted within carriage 52. Each container 72, 414, 430 is releasably connectable to a reciprocating printhead 62, 64.

First over-sized container 414 and second over-sized container 430 each comprise substantially the same features and attributes of the container 74 (as previously described in association with FIGS. 2-9) except have a slightly different size of their respective second portions. In particular, first over-sized container 414 includes a first portion 416 and a second portion 418 while second over-sized container 430 includes a first portion 436 and a second portion 438. First portion 416 of first over-sized container 414 has substantially the same features as the first portion 76 of container 74 while second portion 418 has substantially the same features of the second portion 78. However, in one aspect, second portion 418 of container 414 has a length (L2) that is shorter than the length (L1) of second portion 78 of container 74 (FIG. 2).

In another aspect, first portion 436 of second over-sized container 430 has substantially the same features as the first portion 76 of container 74 while second portion 438 has substantially the same features of the second portion 78. However, in one aspect, second portion 438 of container 430 has a length (L3) that is shorter than the length (L1) of second portion 78 of container 74 (FIG. 2) and shorter than the length (L2) of second portion 418 of container 414. Accordingly, when first and second over-sized containers 414, 430 are viewed together, it can be seen that the length (L2) of second portion 418 accommodates the presence of second portion 438 (having the length L3) of second over-sized container 430.

With this arrangement, more than one container of an ink supply assembly has a volume or ink capacity that is substantially larger than a nominal or normal sized ink supply container and that is substantially larger than the other respective containers in the array. The extra capacity is gained by arranging the second portions 418, 438 of the respective containers 414, 430 to extend over the top portions of the other, reduced-height containers 72.

Finally, it is understood that in some embodiments the ink supply assembly 401 is employed as an off-axis ink supply, in a manner similar to that shown in FIG. 10, except having a different combination of ink supply containers than shown in FIG. 10.

Figure 12:
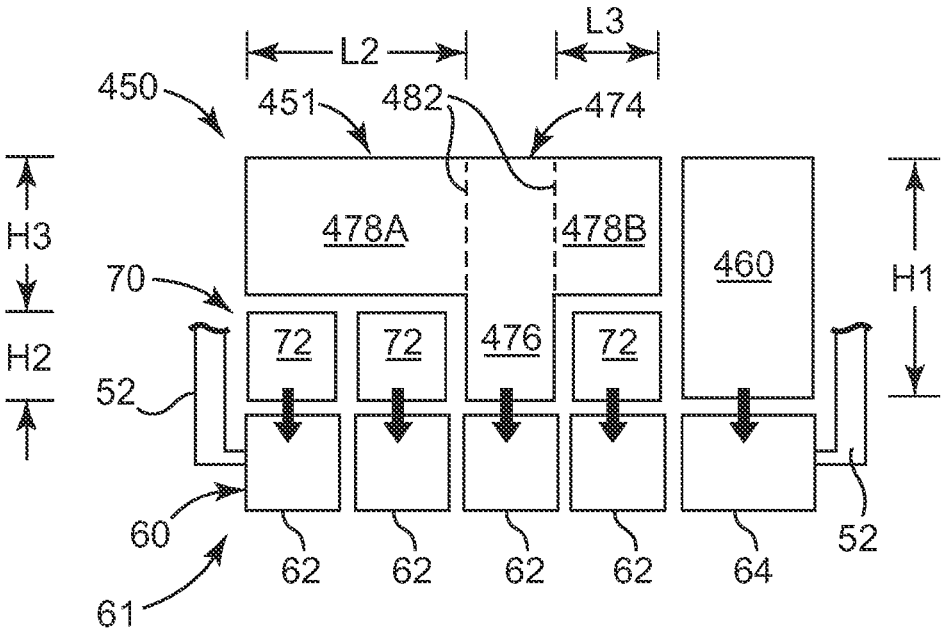
FIG. 12 is front plan view schematically illustrating a printhead assembly and an ink supply assembly, according to one embodiment of the present disclosure.

FIG. 12 illustrates a system 450 including a printhead assembly 61 and an ink supply assembly 451, according to one embodiment of the present disclosure. In one embodiment, the system 450 comprises substantially the same features and attributes of the system 50 (as previously described in association with FIG. 2) except that in system 450 the over-sized container 474 is positioned in a middle portion of the ink supply assembly 451. In one aspect, ink supply assembly 451 includes an array 70 of containers 72, a large container 460, and an over-sized container 474. Each container 72, 460, 474 is releasably connectable to a reciprocating printhead 62, 64, respectively.

Over-sized container 474 comprises substantially the same features and attributes of the container 74 (as previously described in association with FIGS. 2-9) except have a slightly different size and having two separate second portions 478A, 478B that extend outward (instead of having one second portion 67) from opposite sides of first portion 476. Lines 482 denote a boundary between first portion 476 and the respective second portions 478A, 478B. In one aspect, first portion 476 of over-sized container 474 has substantially the same features as the first portion 76 of container 74 while second portions 478A, 478B have substantially the same features of the second portion 78 of container 74 (FIG. 2). Although the second portions 478A, 478B are separate from each other, both of the second portions 478A, 478B hold a volume of free ink and are in fluid communication with the first portion 476. In another aspect, second portion 478B has a length (L3) that is shorter than the length (L2) of second portion 478A. As in the other embodiments, the second portions 478A, 478B extend over the top portion of the other, reduced-height containers 72.

In another embodiment, container 460 is modified to have a height (H2) that matches the height of the other reduced-height containers 72. This arrangement would allow second portion 478B to have a longer length (L2 instead of L3) that extends over a top portion of the modified, reduced height container 460.

Finally, it is understood that in some embodiments the ink supply assembly 451 is employed as an off-axis ink supply, in a manner similar to that shown in FIG. 10, except having a different combination of ink supply containers than shown in FIG. 10.

It is to be understood that the features of the various exemplary embodiments described herein may be combined with each other, unless specifically noted otherwise.

Embodiments of the present disclosure provide various ways to adapt an ink supply assembly to substantially increase the capacity of at least one color of ink in the ink supply assembly without modifying the printhead assembly or without modifying the carriage that supports the ink supply containers. Moreover, in at least one embodiment, this increased capacity for at least one ink is achieved without eliminating the other colors of the ink supply assembly.

Although specific embodiments have been illustrated and described within the present disclosure, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

What is claimed is:

1. An ink supply container comprising:

a first portion configured to hold a first volume of ink and configured to be releasably connectable to a printhead; and a second portion extending at a generally perpendicular orientation from the first portion, configured to hold a second volume of ink, and in communication with the first portion, wherein the second portion is configured to extend over a top of at least one other ink supply container upon releasable connection of the first portion of the container to a printhead assembly, wherein the second portion includes a first ink-containable component and a second ink-containable component, and wherein the first portion is interposed between the first ink-containable component and the second ink-containable component such that the first and second ink-containable components extend outwardly from opposite sides of the first portion.

2. The ink supply assembly of claim 1, wherein the other container and the container are configured to be removably supportable via a carriage and releasably connectable to an array of printheads that are supported via the carriage.

3. An ink supply assembly comprising:

a first ink supply container including:

a first portion configured to hold a first volume of ink and configured to be releasably connectable to a printhead; and a second portion extending at a generally perpendicular orientation from the first portion, configured to hold a second volume of ink, and in communication with the first portion; and an array of other ink supply containers, wherein each respective other container is configured to hold ink, and wherein upon installation of the other containers and the first container relative to a support frame, the second portion of the container extends over the top of at least some of the other containers, wherein the other ink supply containers and the ink supply container are configured as an off-axis ink supply to be located remotely from an array of printheads of a printhead assembly and configured to be releasably connectable to the respective printheads via an array of conduits extending between the ink supply assembly and the printheads.

4. The ink supply container of claim 3, wherein the first portion includes:

a first compartment containing at least one capillarity media and configured to hold ink within the at least one capillarity media;

a second compartment configured to hold free ink; and a wall interposed between and separating the first compartment from the second compartment, wherein the wall includes a passage enabling fluid communication between the first compartment and the second compartment, wherein the second portion of the container is in fluid communication with the second compartment of the first portion of the container.

5. The ink supply container of claim 4, wherein the second portion extends outwardly from one side of the first portion.

6. The ink supply assembly of claim 3, wherein the container is configured to hold a first color of ink and each other container is configured to hold an ink having a different color than the first color of ink.

7. The ink supply assembly of claim 6, wherein the first color of ink is a black ink.

8. An ink supply assembly comprising:

a frame; and an array of ink supply containers, each container including a first portion configured to be releasably connectable to a printhead array accessible via the frame and with the respective first portions arranged within the frame in a side-by-side configuration, wherein the respective containers include:

a first container defining a generally L-shaped member including a respective one of the first portions and a second portion in communication with the first portion, wherein the second portion is configured to extend over a top of at least some of the other respective containers, a second container that defines a generally L-shaped member having a respective one of the first portions and a second portion in communication with the first portion, wherein the second portion of the second container is configured to extend over a top of at least some of the other respective containers, and wherein the second container is positioned relative to the first container such that both the first and second container are simultaneously mountable within the frame.

9. The ink supply assembly of claim 8, wherein a top portion of the other respective ink supply containers includes at least one of a key hole or a key and wherein a bottom surface of the second portion of the respective first and second containers includes a respective other one of the key hole or key to enable reciprocal mating of the top portion of the other ink supply containers relative to the bottom surface of the second portion of a respective one of the first and second containers.

10. An ink supply assembly comprising:

a frame; and an array of ink supply containers including at least a first container, each container including a first portion configured to be releasably connectable to a printhead array accessible via the frame and with the respective first portions arranged within the frame in a side-by-side configuration, wherein the first container has a respective one of the first portions and a second portion including a first ink-containable component and a second ink-containable component, and wherein the first portion is interposed between the first ink-containable component and the second ink-containable component such that the first and second ink-containable components extend outwardly from opposite sides of the first portion of the first container.

11. The ink supply assembly of claim 10, wherein the array of ink supply containers includes a second container that defines a generally L-shaped member having a respective one of the first portions and a second portion in communication with the first portion, wherein the second portion of the second container is configured to extend over a top of at least some of the other respective containers, and wherein the second container is positioned relative to the first container such that both the first and second container are simultaneously mountable within the frame.

* * * * *

UNITED STATES PATENT AND TRADEMARK OFFICE

CERTIFICATE OF CORRECTION

PATENT NO. : 8,657,424 B2
APPLICATION NO. : 13/255275
DATED : February 25, 2014
INVENTOR(S) : William Jon Rittgers et al.

It is certified that error appears in the above-identified patent and that said Letters Patent is hereby corrected as shown below:

In The Specification

In column 1, line 2, below "INK SUPPLY CONTAINER"
insert -- Cross-Reference to Related Applications
This Application is a National Phase Application that claims priority to PCT Application Number PCT/US09/36555, entitled "INK SUPPLY CONTAINER." having a filing date of Mar. 9, 2009 and which is incorporated herein by reference. --.

In column 2, lines 3-19, delete "In the following Detailed Description, reference is made to the accompanying drawings, which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments can be positioned in a number of different orientations, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims." and insert -- In the following detailed description, reference is made to the accompanying drawings which form a part hereof, and in which is shown by way of illustration specific embodiments of the present disclosure that may be practiced. In this regard, directional terminology, such as "top," "bottom," "front," "back," "leading," "trailing," etc., is used with reference to the orientation of the Figure(s) being described. Because components of embodiments of the present disclosure can be positioned in a number of different orientations, the directional terminology is used for purposes of illustration and is in no way limiting. It is to be understood that other embodiments may be utilized and structural or logical changes may be made without departing from the scope of the present Signed and Sealed this
Ninth Day of December, 2014

Michelle K. Lee

Michelle K. Lee
*Deputy Director of the United States Patent and Trademark Office* disclosure. The following detailed description, therefore, is not to be taken in a limiting sense, and the scope of the present disclosure is defined by the appended claims. --, therefor.

In column 10, lines 26-35, delete "Although specific embodiments have been illustrated and described within the present disclosure, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof." and
insert -- Although specific embodiments have been illustrated and described herein, it will be appreciated by those of ordinary skill in the art that a variety of alternate and/or equivalent implementations may be substituted for the specific embodiments shown and described without departing from the scope of the present disclosure. This application is intended to cover any adaptations or variations of the specific embodiments discussed herein. Therefore, it is intended that this present disclosure be limited only by the claims and the equivalents thereof. --, therefor.

In the Claims

In column 10, line 55, in Claim 2, delete "assembly" and insert -- container --, therefor.

In column 10, line 55, in Claim 2, after "the" insert -- at least one --.